US006558263B1

(12) United States Patent
Matsuyama

(10) Patent No.: US 6,558,263 B1
(45) Date of Patent: May 6, 2003

(54) FORGING METHOD OF A HOLLOW PART

(76) Inventor: Mitsuru Matsuyama, 2-129, Hirai-cho, Tajimi-shi, Gifu-ken (JP)

( * ) Notice: Subject to any disclaimer, the term of this patent is extended or adjusted under 35 U.S.C. 154(b) by 41 days.

(21) Appl. No.: 10/000,881

(22) Filed: Nov. 2, 2001

(51) Int. Cl.[7] ..... B21D 53/24
(52) U.S. Cl. ..... 470/26; 470/18; 470/25
(58) Field of Search ..... 470/18, 25, 26, 470/87, 89, 197, 706

(56) References Cited

U.S. PATENT DOCUMENTS 2,542,023 A * 2/1951 Friedman ..... 470/26
4,253,323 A * 3/1981 Murakami et al. ..... 72/356
4,299,000 A * 11/1981 Koch ..... 470/25
4,422,196 A * 12/1983 Skinner ..... 470/18
5,524,471 A * 6/1996 Nielson ..... 72/339

* cited by examiner

*Primary Examiner*—Ed Tolan
(74) *Attorney, Agent, or Firm*—Davis & Bufold, P.L.L.C.

(57) ABSTRACT

A forging method which enables formation of a hollow part by simple processes. In a cutting process, a cylinder blank 1 is cut at the upsetting ratio of L/D=1.5–2.0. In a first process, the cylinder blank 1 is upset in accordance with the outer shape of a nut. The height h of a semi-manufactured product 2 should be lower than the height h of a final product 4. In a second process, dents 3*a* and 3*b* are formed on both sides by extrusion. The depth of the dents 3*a* should be deeper than the other. The height of the semi-manufactured product 3 in the second process should be as tall as the height of the final product 4. In a third process, piercing is performed to the bottom portion of the deeper dent 3*a* so that both dents 3*a* and 3*b* can communicate.

9 Claims, 8 Drawing Sheets

TURN OVER

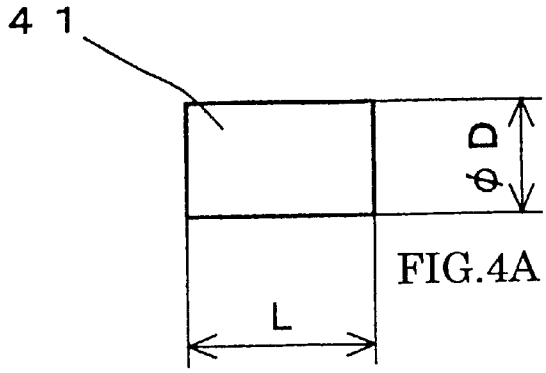
FIG.4A
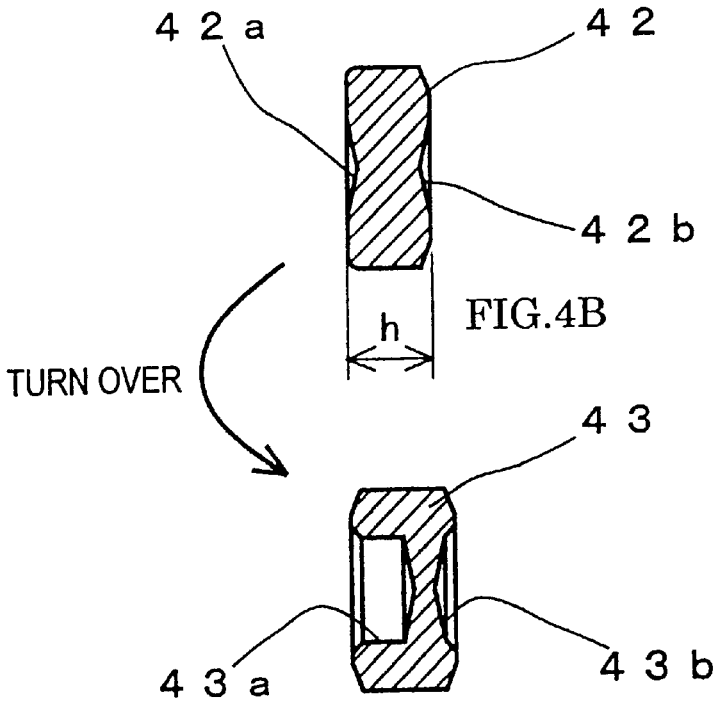
FIG.4B
FIG.4C
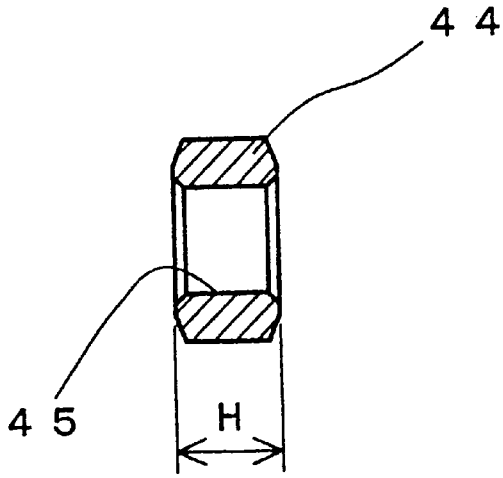
FIG.4D

TURN OVER

TURN OVER

TURN OVER

FORGING METHOD OF A HOLLOW PART

FIELD OF THE INVENTION

This invention relates to a forging method of producing a hollow part from a cylinder blank.

BACKGROUND OF THE INVENTION

A conventional method for forging a nut contains the following steps as illustrated in FIGS. 5A–J. A blank 101 is cut so that a diameter D of the blank 101 may be smaller than the width B across the flat portions of the nut by approximately 0.4 mm and also have a large flat cross section. In a first process, the blank 101 are chamfered to produce a cylindrical semi-manufactured product 102. In a second process, a semi-manufactured product 103 having its outer shape preformed to be hexagonal is obtained. In a third process, dents 104*a* and 104*b* to be used for forming a female thread are created on a semi-manufactured product 104. In a fourth process, the semi-manufactured product 104 having the dents 104*a* and 104*b* is further extruded to form a semi-manufactured product 105 having deeper dents 105*a* and 105*b*. Then in a fifth process, piercing is performed to the remaining portion between the dents 105*a* and 105*b*, and a final product 106 having a pierced hole 106*a* is obtained. In the next process, a female thread is formed in the pierced hole 106*a*.

However, such a conventional method requires a large number of processes like chamfering and preforming to forge a hollow part, and the processes are complicated.

SUMMARY OF THE INVENTION

An object of the present invention is to provide a forging method which enables forging of a hollow part by simplified processes.

In order to attain the above object, the present invention provides a forging method of a hollow part comprising steps of upsetting a cylinder blank having the upsetting ratio of 1.5–2.0 so that the blank has the smaller outer shape and the lower height than those of the part to be formed, forming dents on both sides of the blank in the direction of the height of the part; and piercing the bottom portion of the dents to create a pierced hole in the blank.

It is preferable that the depth of the dents are made different. Also, if the part is selected from the group consisting of a nut, a hub nut and a flange nut, it is preferable to form a female thread after a pierced hole is created. The part could be a bush collar.

BRIEF DESCRIPTION OF THE DRAWINGS

The invention will now be described, by way of example, with reference to the accompanying drawings, in which:

FIGS. 4A–D area process chart showing an exemplary order of manufacturing processes of a bush collar according to a forging method of a hollow part of the invention;

DETAILED DESCRIPTION OF THE INVENTION

Figure 1A:
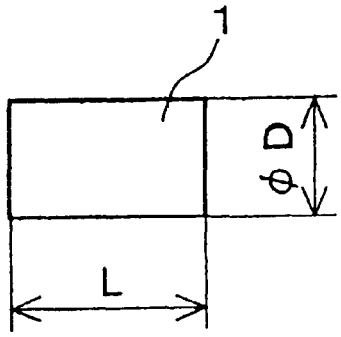
FIGS. 1A–G are a process chart showing an exemplary order of manufacturing processes of a nut according to a forging method of a hollow part of the invention.

As shown in FIG. 1A, a cylinder blank 1 is cut off from a long sheet blank in a cutting process, so that the upsetting ratio L/D (D: diameter of the cylinder blank 1; L: height of the cylinder blank 1) of the blank 1 may be 1.5–2.0.

Figure 1B:
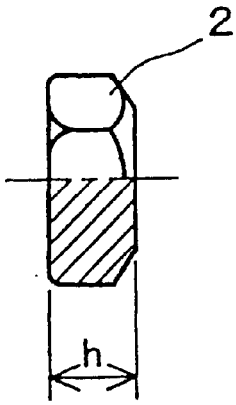
Figure 1C:
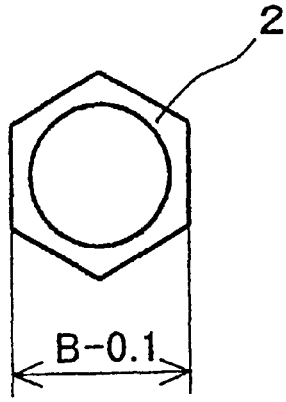

In a subsequent first process, see FIGS. 1B, 1C, the cylinder blank 1 is upset in accordance with the outer shape of a part to be formed, that is, a nut. The width across the flat portions of a semi-manufactured product 2 in the first process should be made smaller than the width B across the flat portions of the nut (a final product 4) by approximately 0.1 mm. Also, the height h of the semi-manufactured product 2 should be made lower than the height H of the final product 4.

Figure 1D:
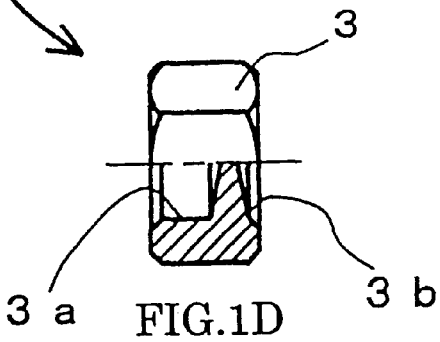
Figure 1E:
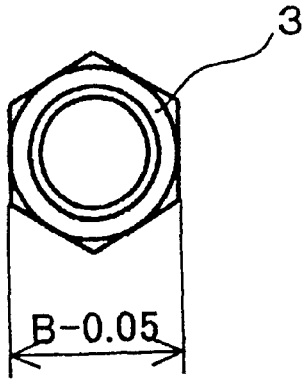

In the second process, see FIGS. 1D, 1E, the semi-manufactured product 2 in the first process is turned over and dents 3*a* and 3*b* are formed on both sides by extrusion. The depth of the dents 3*a* and 3*b* are different, and the dent 3*a* is made deeper than the other. The height of the semi-manufactured product 3 in the second process should be as tall as that of the final product 4, and the width across the flat portions thereof should be smaller than the width B by approximately 0.05 mm.

Figure 1F:
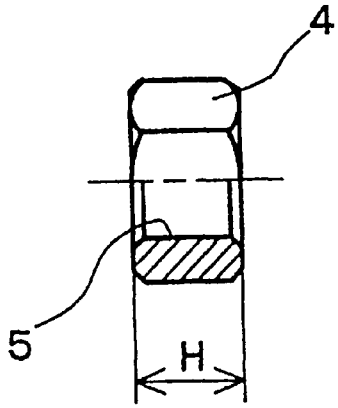
Figure 1G:
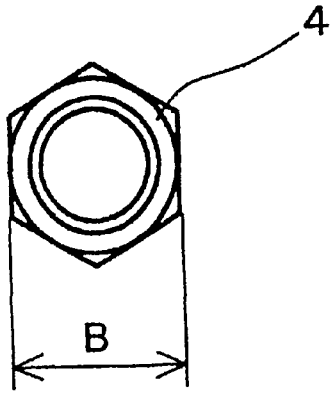

In a third process, see FIGS. 1F, 1G, piercing is performed to the bottom portion of the deeper dent 3*a* so that both dents 3*a* and 3*b* can communicate, and the final product 4 is produced. The width across the flat portions of the final product 4 should be as large as the width B. After a pierced hole 5 is created, a female thread is formed therein in the next process, and the final product 4 becomes a nut. As above, the forging method of a hollow part in the present embodiment requires no specific process for chamfering, hexagonal preforming, etc. compared to a conventional forging method illustrated in FIGS. 5A–J. Therefore, the total number of the processes decreases and the manufacturing of the part is simplified.

Figure 2A:
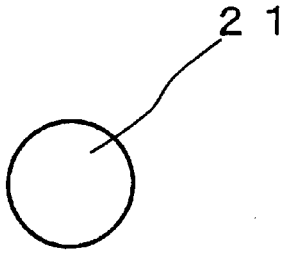
FIGS. 2A–H are a process chart showing an exemplary order of manufacturing processes of a hub nut according to a forging method of a hollow part of the invention.
Figure 2B:
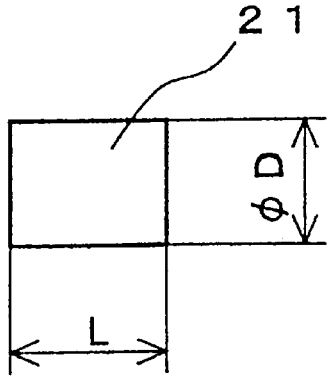

Now, a manufacturing method of a hub nut is described as a second embodiment according to the forging method of a hollow part of the present invention. As illustrated in FIGS. 2A, 2B, a cylinder blank 21 is cut in a cutting process, so that the upsetting ratio L/D may be 1.5–2.0. A diameter D of the cylinder blank 21 should be the same as a diameter D1 of a tip of a tapering part of the hub nut.

Figure 2C:
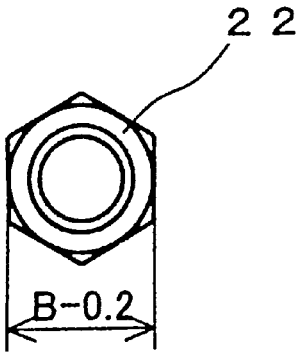
Figure 2D:
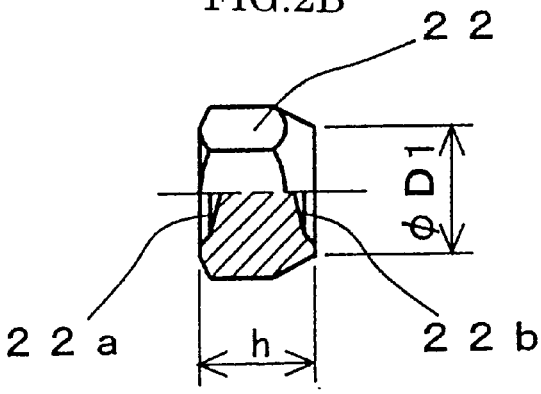

In a first process, see FIGS. 2C, 2D, the cylinder blank 21 is upset so that the width across the flat portions of a semi-manufactured product 22 in the first process should be smaller than the width B across the flat portions of the hub nut (a final product 24) by approximately 0.2 mm. Also, the height h of the semi-manufactured product 22 should be lower than the height H of the final product 24. In the first process, shallow dents 22*a* and 22*b* are preformed on both sides of the semi-manufactured product 22.

Figure 2E:
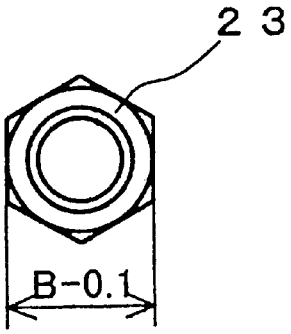
Figure 2F:
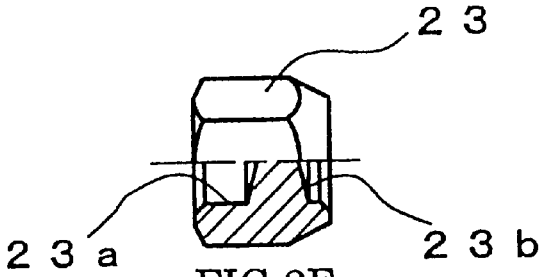

In a second process, see FIGS. 2E, 2F, dents 23*a* and 23*b* are formed on both sides of the semi-manufactured product 22 by extrusion. The dents 23*a* and 23*b* have a different depth and the dent 23*a* is made deeper than the other. The height of a semi-manufactured product 23 should be as tall as that of the final product 24, and the width across the flat portions of the semi-manufactured product 23 should be made smaller than the width B by approximately 0.1 mm.

Figure 2G:
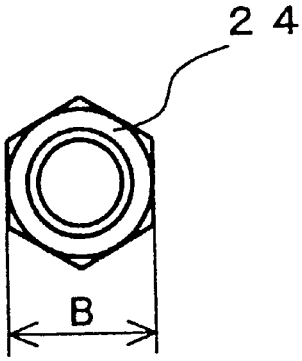
Figure 2H:
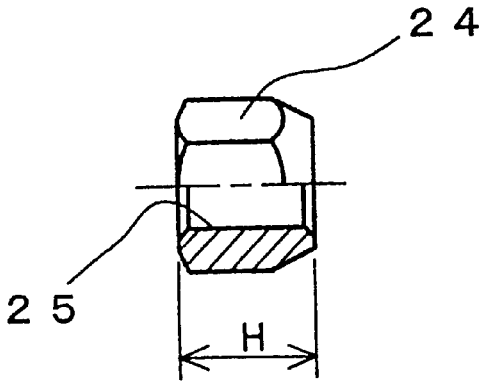

In a third process, see FIGS. 2G, 2H, piercing is performed to the bottom portion of the deeper dent 23*a* so that both dents 23*a* and 23*b* can communicate, and the final product 24 is produced. The width across the flat portions of the final product 24 should be equal to the width B. After a pierced hole 25 is created, a female thread is formed therein in the next process, and the final product 24 becomes a hub nut.

As described, the forging method of a hollow part in the second embodiment requires no specific processes like chamfering, hexagonal preforming, etc. compared to a conventional forging method illustrated in FIGS. 6A–L. Therefore, the total number of the processes decreases and the manufacturing of the part is simplified. If a hub nut should be produced according to the conventional forging method illustrated in FIGS. 6A–L, the following processes are necessary. Initially in FIGS. 6A, 6B, a blank 201 is cut so that a diameter of the blank 201 may be smaller than the width B across the flat portions of the hub nut by approximately 0.6 mm. In a first process, see FIGS. 6C, 6D, the blank 201 is chamfered to produce a cylindrical semi-manufactured product 202. In a second process, a semi-manufactured product 203 having its outer shape preformed to be hexagonal is obtained.

Figure 6A:
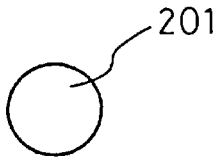
FIGS. 6A–L are a process chart showing an order of conventional manufacturing processes of a hub nut.
Figure 6B:
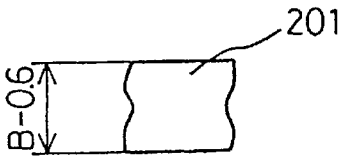
Figure 6C:
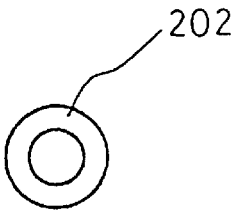
Figure 6D:
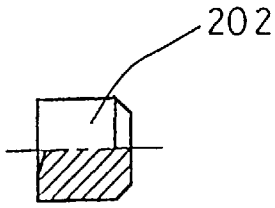
Figure 6E:
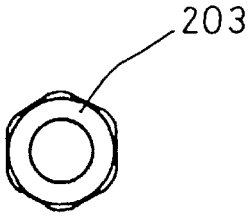
Figure 6F:
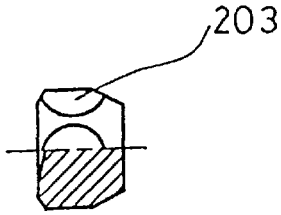
Figure 6G:
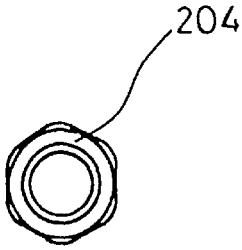
Figure 6H:
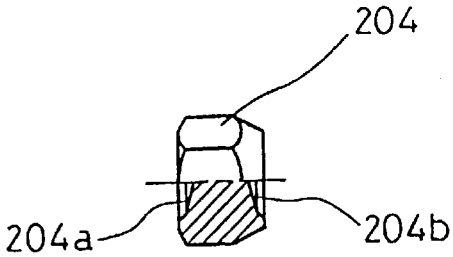
Figure 6I:
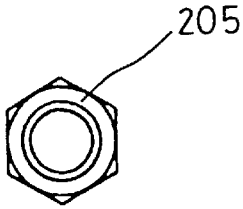
Figure 6J:
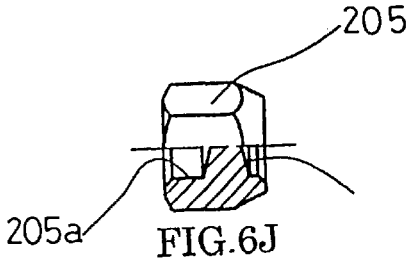
Figure 6K:
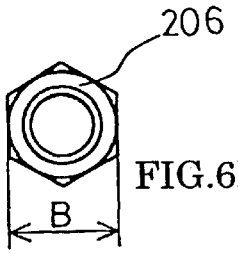
Figure 6L:
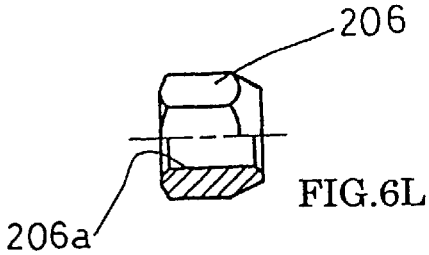

In a third process, see FIGS. 6G, 6H, while the outer shape is formed, dents 204*a* and 204*b* to be used for forming a female thread are created on a semi-manufactured product 204. In a fourth process, see FIGS. 6I, 6J, the semi-manufactured product 204 having the dents 204*a* and 104*b* is further extruded to form a semi-manufactured product 205 having deeper dents 205*a* and 205*b*. Then in a fifth process, see FIGS. 6K, 6L, piercing is performed to the remaining portion between the dents 205*a* and 205*b*, and a final product 206 with a pierced hole 206*a* is obtained. In this case, a large number of processes are necessary. However, the forging method of a hollow part in the second embodiment requires no specific process for chamfering, hexagonal preforming, etc. compared to the conventional forging method. Therefore, the total number of the processes decreases and the manufacturing is simplified.

Figure 3A:
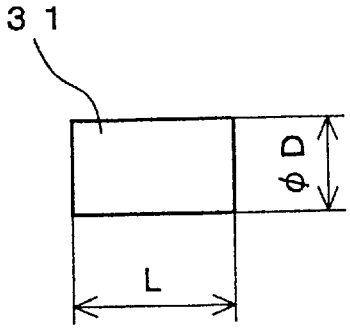
FIGS. 3A–J are a process chart showing an exemplary order of manufacturing processes of a flange nut according to a forging method of a hollow part of the invention.
Figure 3B:
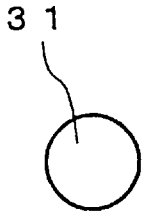
Figure 3C:
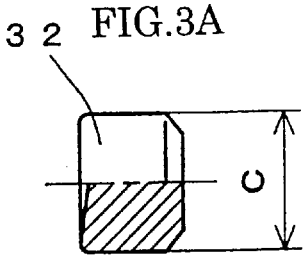
Figure 3D:
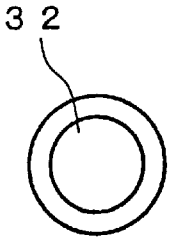

Subsequently, a manufacturing method of a flange nut is described as a third embodiment according to the forging method of a hollow part of the present invention. As illustrated in FIGS. 3A, 3B, a cylinder blank 31 is cut in a cutting process, so that the upsetting ratio L/D may be 1.5–2.0. In a first process, see FIGS. 3C, 3D, the cylinder blank 31 is upset and chamfered so that a diameter of a cylindrical semi-manufactured product 32 in the first process should be as large as the diagonal dimension C of the flange nut (a final product 35). The width B across the flat portions of the flange nut is also shown for comparison.

Figure 3E:
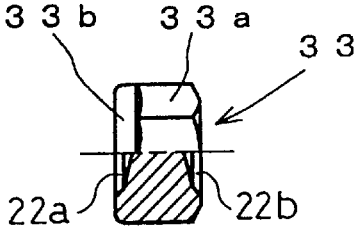
Figure 3F:
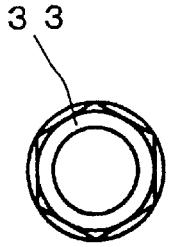
Figure 3G:
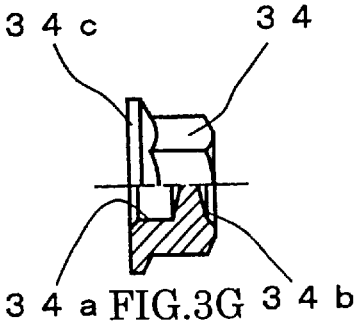
Figure 3H:
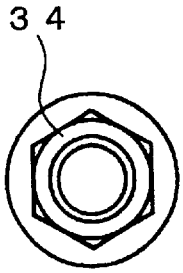

In a second process, see FIGS. 3E, 3F, a hexagonal portion 33*a* as well as a cylindrical portion 33*b* that will make a flange are created, and shallow dents 22*a* and 22*b* are preformed on both sides of a semi-manufactured product 33. In a third process, see FIGS. 3G, 3H, while dents 33*a* and 33*b* are formed on both sides of the semi-manufactured product 33 by extrusion, a flange 34*c* is created. The dents 34*a* and 34*b* have a different depth and the dent 34*a* is made deeper than the other.

Figure 3I:
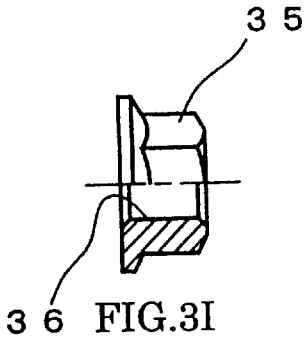
Figure 3J:
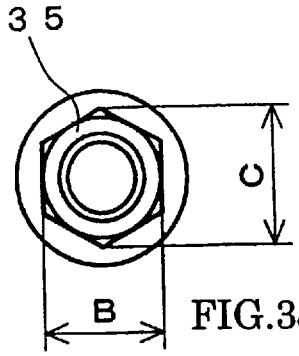
Figure 5A:
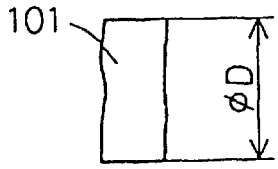
FIGS. 5A–J are a process chart showing an order of conventional manufacturing processes of a nut.
Figure 5B:
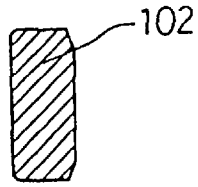
Figure 5C:
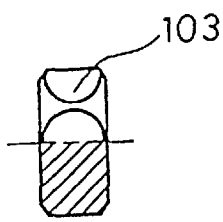
Figure 5D:
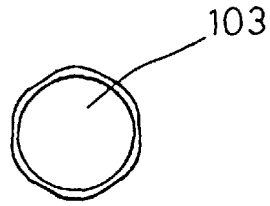
Figure 5E:
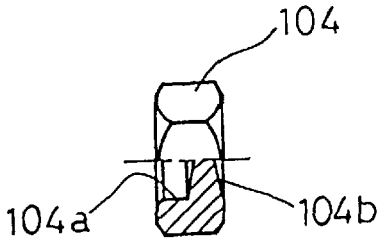
Figure 5F:
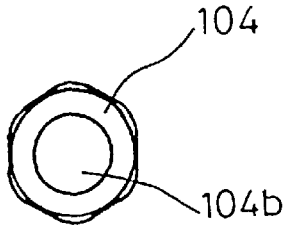
Figure 5G:
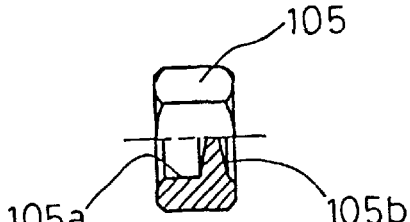
Figure 5H:
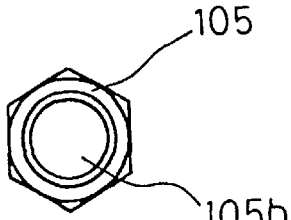
Figure 5I:
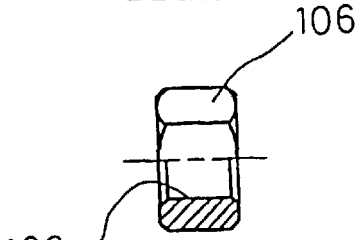
Figure 5J:
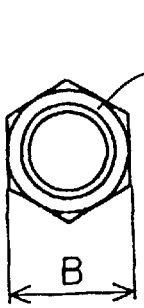

The height of a semi-manufactured product 34 in a third process should be as tall as that of the final product 35. In a fourth process, see FIGS. 3I, 3J, piercing is performed to the bottom portion of the deeper dent 34*a* so that both dents 34*a* and 34*b* can communicate, and the final product 35 is produced. After a pierced hole 36 is created, a female thread is formed in the pierced hole 36 in the next process, and the final product 35 becomes a flange nut.

As described, the forging method of a hollow part in the third embodiment requires no specific processes like chamfering, hexagonal preforming, etc. compared to a conventional forging method illustrated in FIGS. 7A–L. Therefore, the total number of the processes decreases and the manufacturing of the part is simplified. If a flange nut should be produced according to the conventional forging method of FIGS. 7A–L, the following processes are necessary. Initially in FIGS. 7A, 7B, a blank 301 is cut so that a diameter of the blank 301 may be smaller than the width B across the flat portions of the flange nut by approximately 0.6 mm. In a first process, see FIGS. 7*c*, 7D, since there is high possibility that a shear gap occurs when cutting, the blank 301 is chamfered to produce a cylindrical semi-manufactured product 302. In a second process, see FIGS. 7E, 7F, a semi-manufactured product 303 having its outer shape preformed to be hexagonal at the heading ratio of 1.1–1.3 is obtained.

Figure 7A:
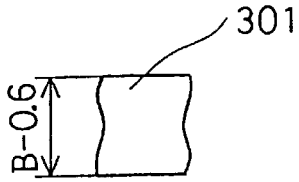
FIGS. 7A–L are a process chart showing an order of conventional manufacturing processes of a flange nut.
Figure 7B:
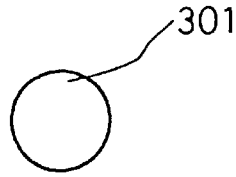
Figure 7C:
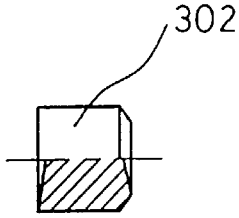
Figure 7D:
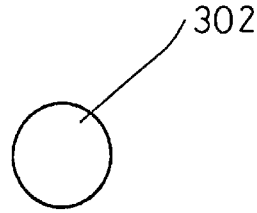
Figure 7E:
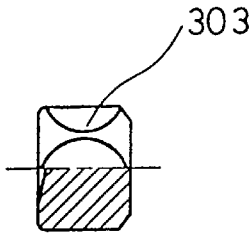
Figure 7F:
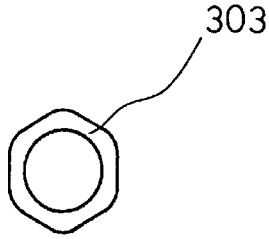
Figure 7G:
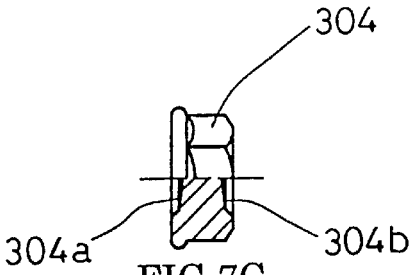
Figure 7H:
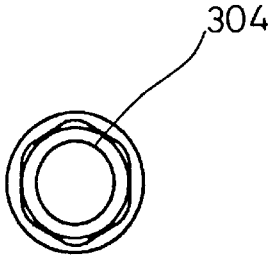
Figure 7I:
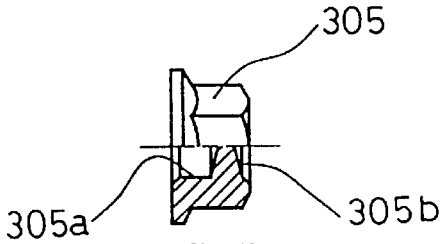
Figure 7J:
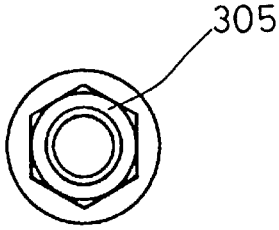

In a third process, see FIGS. 7G, 7H, while the outer shape is formed, dents 304*a* and 304*b* to be used for forming a female thread are created on a semi-manufactured product 304. However, since the upsetting ratio is small, a heavy load applied to a die or punch pin may cause damage. In a fourth process, see FIGS. 7I, 7J, the semi-manufactured product 304 having the dents 304*a* and 304*b* is further extruded and a semi-manufactured product 305 having dents 305*a* and 305*b* is obtained.

Figure 7K:
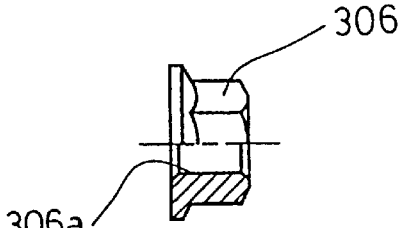
Figure 7L:
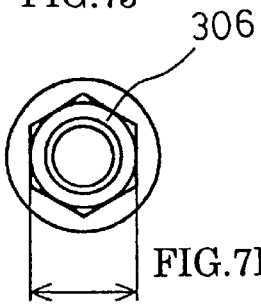

Then in a fifth process, see FIGS. 7K, 7L, piercing is performed to the remaining portion between the dents 305*a* and 305*b*, and a final product 306 having a pierced hole 306*a* is obtained. In this case, a large number of processes are necessary. However, the forging method of a hollow part in the third embodiment requires no specific process for chamfering, hexagonal preforming, etc. compared to the conventional forging method. Therefore, the total number of the processes decreases and the manufacturing is simplified.

Subsequently, a manufacturing method of a bush collar is described as a fourth embodiment according to the forging method of a hollow part of the present invention. As illustrated in FIG. 4A, a cylinder blank 41 is cut in a cutting process, so that the upsetting ratio L/D may be 1.5–2.0. In a first process, see FIG. 4B, the cylinder blank 41 is chamfered so that the height of a cylindrical semi-manufactured product 42 in the first process should be shorter than the height H of a final product 44. In the first process, shallow dents 42*a* and 42*b* are preformed on both sides of a semi-manufactured product 42.

In a second process, see FIG. 4C, dents 43*a* and 43*b* are formed on both sides of the semi-manufactured product 42 by extrusion. The dents 43*a* and 43*b* have a different depth and the dent 43*a* is made deeper than the other. The height of a semi-manufactured product 43 in the second process should be as tall as that of the final product 44. In a third process, see FIG. 4D, piercing is performed to the bottom portion of the deeper dent 43*a* so that both dents 43*a* and 43*b* can communicate to form a pierced hole 45, and the final product 44 is produced.

As described, the forging method of a hollow part in the fourth embodiment requires no specific processes like chamfering, etc. compared to a conventional forging method illustrated in FIGS. 8A–E. Therefore, the total number of the processes decreases and the manufacturing of the part is simplified.

If a bush collar should be produced according to the conventional forging method of FIGS. 8A–E, the following processes are required. Initially, in FIG. 8A, a blank 401 is cut so that an outside diameter of the disc blank 401 may be the same as that of a final product 405. As a result, the large cross section causes a shear gap and the weight of the blank per piece varies widely. Therefore, a large shear stress becomes necessary.

Figure 8A:
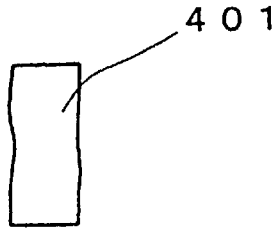
FIGS. 8A–E are a process chart showing an order of conventional manufacturing processes of a bush collar.
Figure 8B:
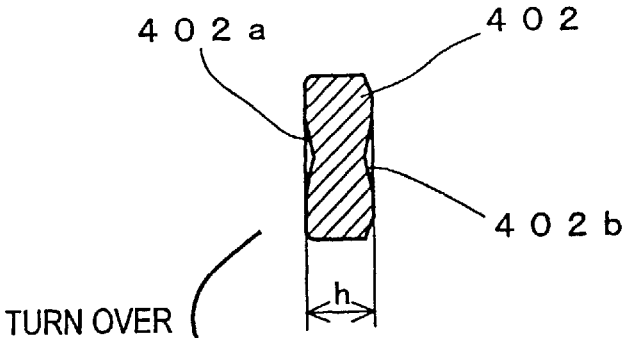
Figure 8C:
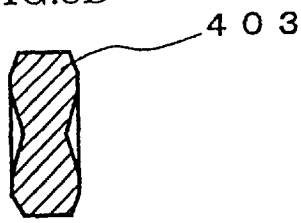
Figure 8D:
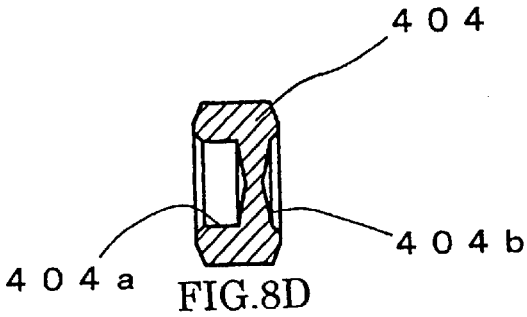
Figure 8E:
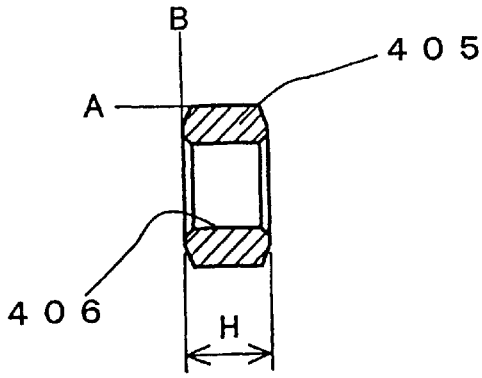

In a first process, see FIG. 8B, the blank 401 is chamfered to produce a cylindrical semi-manufactured product 402. In the first process, shallow dents 402*a* and 402*b* are formed on both sides of the semi-manufactured product 402 by forging. In this case, since the upsetting ratio is small, a heavy load applied to a die or punch pin may cause damage. In a second process, see FIG. 8C, the semi-manufactured product 402 is turned over and a preformed semi-manufactured product 403 is obtained. In the second process as well, since the upsetting ratio is small, a heavy load applied to a die or punch pin may cause damage. In a third process, see FIG. 8D, dents 404*a* and 404*b* are formed on a semi-manufactured product 404 by extrusion. Then in a fourth process, see FIG. 8E, piercing is performed to the remaining portion between the dents 404*a* and 404*b*, and a final product 405 having a pierced hole 406*a* is obtained.

In this case, since a runout occurs between the outer circumference A and the flat portion B, the rectangular plane becomes uneven and the fiber flow may not be uniform. A large number of processes are necessary as well. However, the forging method of a hollow part in the fourth embodiment requires no specific process for chamfering, hexagonal preforming, etc. Therefore, the total number of the processes decreases and the manufacturing is simplified.

The present invention is not limited to the above embodiments, and other modifications and variations are possible within the scope of the present invention.

Additionally, in the above embodiments, the extrusion for creating dents on a semi-manufactured product is performed by pressing both sides of a disc, which is the semi-manufactured product placed in a die, by a punch. When the punch goes deep into the disc, the peripheral portion around the punch on both sides of the disc rises and forms dents.

What is claimed is:

1. The method for forging a hollow part, the method comprising the steps of:

cutting an initial cylindrical part blank having an opposing first and second ends spaced apart by an initial length L along a longitudinal axis and defining a substantially cylindrical outer periphery therebetween having an initial outer width D defining an upsetting ratio L/D in the range of about 1.5–2.0;

upsetting the initial part blank to form an intermediate part blank having an intermediate length and an intermediate width;

forming opposing first and second coaxial indentations in the respective first and second ends of the intermediate part blank about the longitudinal axis; and piercing a bottom portion of one of said first and second indentations to form a throughbore extending along the longitudinal axis between the first and second ends to produce the hollow part having a final width and final length greater than the respective intermediate width and intermediate length of the intermediate part blank.

2. The method for forging a hollow part as set forth in claim 1 further comprising the step of forming one of said opposing first and second coaxial indentations in the respective first and second ends of the intermediate part blank deeper than the respective other indentation.

3. The method for forging a hollow part as set forth in claim 2 wherein after the step of upsetting the initial part blank to form an intermediate part blank, turning over the intermediate part blank to facilitate the step of forming the opposing first and second coaxial indentations in the respective first and second ends of the intermediate part blank.

4. The method for forging a hollow part as set forth in claim 2 wherein said first and second coaxial indentations are formed by extrusion.

5. The method for forging a hollow part as set forth in claim 4 wherein forming the first and second indentations influences the intermediate length of the part blank to substantially attain the final length.

6. The method for forging a hollow part as set forth in claim 4 wherein extrusion of the first and second indentations influences the intermediate length of the intermediate part blank to substantially attain the final length and the intermediate width remains less than the final width.

7. The method for forging a hollow part as set forth in claim 1 wherein the step of upsetting the initial part blank forms the intermediate part blank having the intermediate width being about 0.1 mm less than the final width.

8. The method for forging a hollow part as set forth in claim 7 wherein the step of forming opposing first and second coaxial indentations in the respective first and second ends of the intermediate part blank causes the intermediate width to attain a second intermediate width being about 0.05 mm less than the final width.

9. A method for forging a hollow part, the method comprising the steps of:

cutting an initial cylindrical part blank having an opposing first and second ends separated by an initial length L along a longitudinal axis and defining a substantially cylindrical outer periphery therebetween having an initial outer width D defining an upsetting ratio L/D in the range of about 1.5–2.0;

upsetting the initial part blank to form an intermediate part blank having an intermediate length and an intermediate width less than a final length and width, the intermediate width being about 0.1 mm less than the final width;

forming opposing first and second coaxial indentations about the longitudinal axis in the respective first and second ends of the intermediate part blank to attain a second intermediate width being about 0.05 mm less than the final width, and one of said opposing first and second coaxial indentations in the respective first and second ends of the intermediate part blank being formed deeper than the respective other indentation; and piercing a bottom portion of one of said first and second indentations to form a throughbore extending between the first and second ends in the blank to produce the hollow part having the final width and final length greater than the respective first and second intermediate widths and intermediate length of the intermediate part blank.

* * * * *